United States Patent [19]

Stowell et al.

[11] Patent Number: 5,067,200

[45] Date of Patent: Nov. 26, 1991

[54] HINGE FOR INSET DOORS

[76] Inventors: Norman L. Stowell, P.O. Box 1560; Brian D. Stowell, 285 Bonmark Dr., both of Claremont, N.H. 03743; Gregory T. Stowell, 169 Portsmouth St., No. 6, Concord, N.H. 03301

[21] Appl. No.: 529,110

[22] Filed: May 25, 1990

[51] Int. Cl.[5] ..... E05D 7/04

[52] U.S. Cl. ..... 16/237; 16/248; 16/252; 16/382; 16/390

[58] Field of Search ..... 16/249, 382, 387, 388, 16/390, 252, 320; 49/381, 395, 399

[56] References Cited

U.S. PATENT DOCUMENTS

| | | | |
|---|---|---|---|
| 1,026,844 | 5/1912 | Bertram | 16/387 |
| 1,145,521 | 7/1915 | Stock | 16/382 |
| 1,311,651 | 7/1919 | Kanster | 16/390 |
| 2,027,888 | 1/1936 | Solomon | 16/249 |
| 3,263,595 | 8/1966 | Bower | 16/320 |
| 3,590,419 | 7/1971 | Dargene | 16/235 |

FOREIGN PATENT DOCUMENTS

| | | | |
|---|---|---|---|
| 62551 | 6/1955 | France | 16/382 |
| 2156425 | 10/1985 | United Kingdom | 16/387 |

*Primary Examiner*—Richard K. Seidel
*Assistant Examiner*—Edward A. Brown
*Attorney, Agent, or Firm*—Michael J. Weins

[57] ABSTRACT

The present invention relates to a hinge suitable for use in cabinets with inset doors. The hinge can be installed and adjusted on the door at the installation site. The hinge, is fully adjustable and will compensate for a cabinet and door distortion. The hinge has hinge wings which are concealed when the door is in the closed position. The hinge which employs a split cabinet wing into which the door wing folds on closing. Having the wings so configured results in reduced separation between the door and the mounting surface on which it is mounted.

The hinge is suitable for a door closure unit wherein the dual catches are employed in the vicinity of the corners into which the door swings.

8 Claims, 4 Drawing Sheets

HINGE FOR INSET DOORS

FIELD OF INVENTION

The present invention relates to a door hinge assembly and in particular to a hinge for mounting inset doors to cabinets.

BACKGROUND ART

There are a variety of door configurations that are used for cabinets. These include overlay doors that are mounted on the face of the cabinet, offset doors which have a portion of the door's thickness contoured to fit into the opening covered by the door, and inset doors where the door lies within the opening that it serves to close.

For cabinets that are fabricated off site and are installed in the field it is preferred that the doors can be installed on site and that the hinge can readily be attached to the door and accommodate adjustment of the doors during installation. This adjustability of the door is needed since the cabinets are tied into walls and floors during the installation and they frequently do not remain square. For the overlay and the offset doors the hinge of U.S. Pat. No. 3,590,419 provides a full range of adjustment by providing slots in the face of the cabinet and the side of the door which allow for adjustment of the door relative to the opening it covers. The slots allow for translational and rotational adjustment in the planes of the slots. The '419 patent provides five degrees of freedom for adjustment when two orthogonal slots are provided. However, the use of a double slot hinge requires a massive hinge and disrupts the face of the cabinet which detracts from the appearance of cabinets with inset doors. This problem has been overcome in part by the teaching of the '419 patent by employing a fixed hinge wing which attaches to the face of the cabinet.

This solution while reducing the mass of the hinge on the face of the cabinet results in a reduction in the degrees of freedom for adjusting the door relative to the door opening. The additional translational and rotational degrees normal to the door opening are lost. Thus if during the course of installation of a cabinet the face of the cabinet warps or the door warps there is no means to compensate for such warpage except by shimming the cabinet wing. The problem of the loss of degrees of freedom becomes more critical in the case of the inset doors since these doors are designed to lie in the plane of the cabinet face and miss-alignment will be apparent.

Furthermore the hinge of the '419 patent face mounts and thus does not provide means for concealing the cabinet wing when an inset door is employed.

Thus there is a need for a hinge for inset doors which are concealed when the doors are closed. The hinge should also be readily field mounted and provide for adjustment such that the door can readily be centered in the door openings.

SUMMARY OF THE INVENTION

It is an object of the present invention to provide a hinge with five degrees of freedom which is suitable for mounting inset doors with concealed hinge wings.

It is another object of the present invention to provide a hinge for on site installation and adjustment.

It is still another object of the present invention to provide a hinge with minimal separation between the door opening and the inset door installed therein.

These and other objects of the invention will become apparent from the following descriptions, drawings and claims.

The hinge of the present invention is employed for inset doors which mount to a sidewall of the door frame and swingably engages the door frame. The door has a slot substantially normal to an edge of the door and parallel to the back surface of the door. The slot communicates with an opening in the back surface of the door. The hinge in its simplest form has a door wing which has a first leg and a second leg. The first leg engages the back surface of the door while the second leg engages the slotted edge of the door. The second leg extends beyond the slotted edge of the door and has a free end which terminates in a door wing knuckle having a passage therethrough. When the door wing is attached to the door the door wing knuckle passage is substantially parallel to the intersection of the slotted edge and the back face of the door.

The first leg has a passage therethrough. A fastening means passes through the passage and the opening in the back surface of the door. A clamping plate is engaged by a clamping means which provides adjustment such that the clamping plate can be positioned to engage a slot in the side of the door. It is preferred that the clamping means be a bolt which threads into the clamping plate.

A split cabinet wing is provided wherein the wing has a first cabinet wing tab and a second cabinet wing tab which are spaced apart, the spacing being such that the second leg of the door wing will fit therebetween. Each of the cabinet wing tabs have a cabinet wing tab knuckle having a passage therethrough. A pin passes through the passages of the cabinet wing tab knuckles and the door wing knuckle joining the three knuckles and provides for rotation between the door wing and the split cabinet wing.

Each of said cabinet wing tabs is provided with a tab slot substantially normal to the passage through the knuckle of the tab for mounting the cabinet wing split to the frame of the door.

In one preferred embodiment of the present invention the cabinet wing tabs are affixed to the pin.

The hinges of the present invention is preferably employed as an element of a cabinet closure system. In this instance the door is secured by a pair of catch mechanisms which are in close proximity to the corners of the door opening opposite the sidewall of the door opening to which the door is swingably engaged. It is further preferred that the catch mechanisms be magnetic.

BEST MODE FOR CARRYING THE INVENTION INTO PRACTICE

Figure 1:
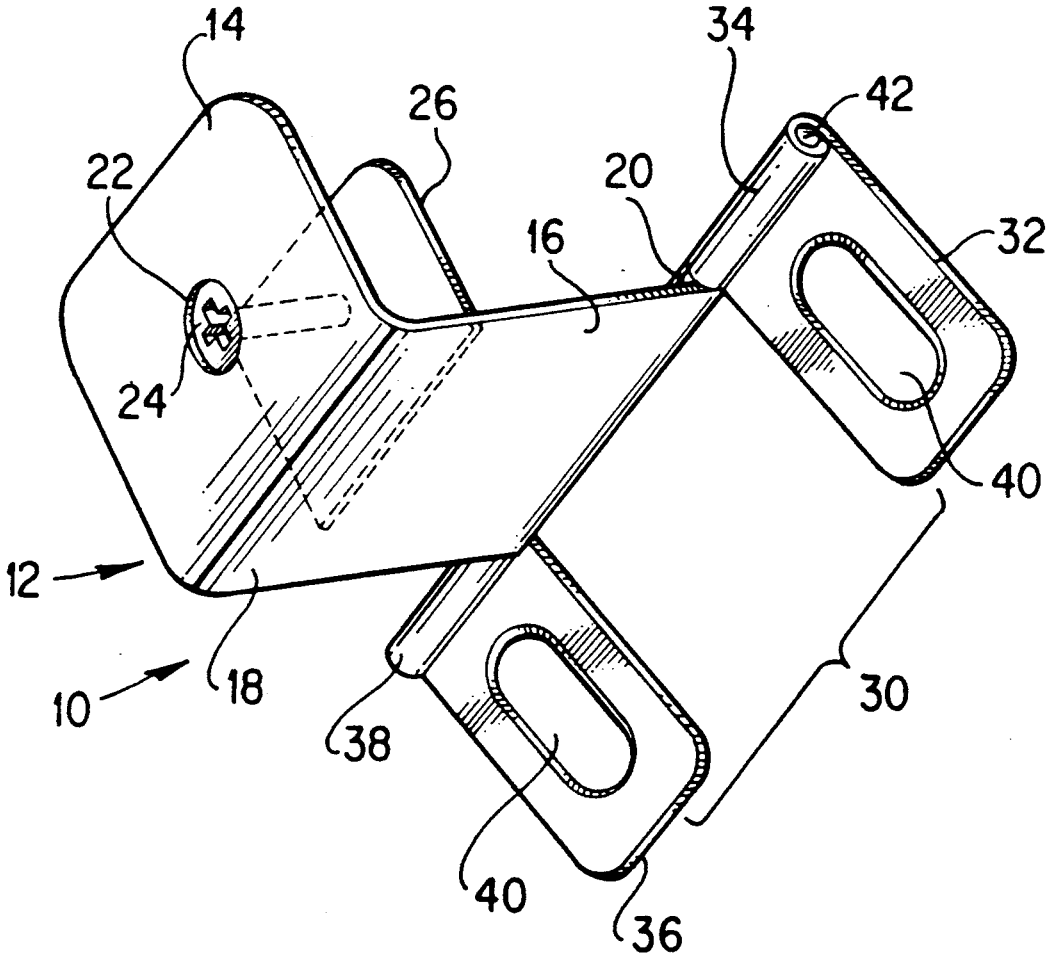
FIG. 1 is a perspective view of the hinge assembly of the present invention showing the interrelation of the various parts of the hinge assembly.

FIG. 1 is a perspective view of the hinge assembly of one embodiment of the present invention. The hinge assembly 10 has a door wing 12. The door wing 12 has a first leg 14 and a second leg 16. The first leg 14 and the second leg 16 meet at an intersection 18. The second leg 16 of the door wing 12 terminates in a door wing knuckle 20 having a passage therethrough substantially parallel to the intersection 18 of the first leg 14 and the second leg 16. The first leg 14 of the door wing 12 has a leg passage 22 therethrough. A clamping means 24 passes through said passage and engages a clamping plate 26. A split cabinet wing 30 has a first wing tab 32 having a first wing tab knuckle 34 and a second wing tab 36 having a second wing tab knuckle 38. The first wing tab 32 and the wing second tab 34 have wing tab slots 40 which are substantially normal to the wing tab knuckles 34 and 38. The wing tab knuckles 34 and 38 have passages therethrough which align with the passage in the door wing knuckle 20 and are engaged by a pin 42 which rotatably joins the tabs 32 and 36 to the door wing 12.

Figure 2:
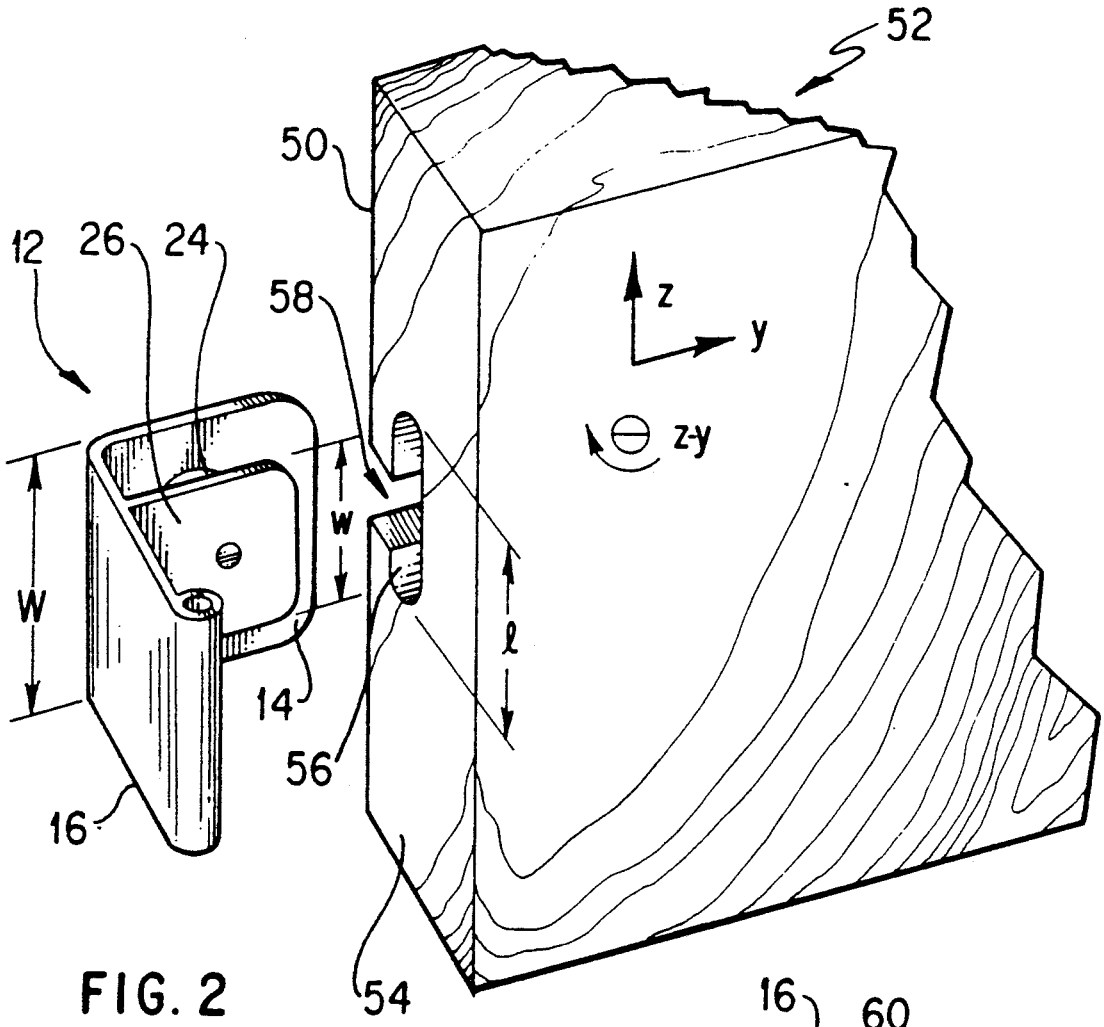
FIG. 2 is an exploded view illustrating how the hinge attaches a door to the cabinet and provides adjustment in the plane of the door.

FIG. 2 illustrates the relative position of the door wing 12 with respect to the door The first leg 14 of the door wing 12 engages the back surface 50 of the door 52. The second leg 16 engages a slotted edge 54 of the door 52. An edge slot 56 runs substantially normal to the slotted edge 54 of the door 52. The clamping plate 26 engages and is adjusted with the clamping means 24. The clamping means 24 provides adjustment with respect to the separation between the first leg 14 of the door wing 12 and the clamping plate 26 such that the clamping plate 26 will engage the edge slot 56. An opening 58 provides for insertion of the clamping plate 26 with the clamping means 24 attached. A translation of the door in the z-y plane and rotation in the z-y plane can be obtained by loosening the fastening means 24 and moving the door relative to the clamping plate 26.

The clamping plate 26 is preferably configured from the flat plate. The clamping plate 26 is so shaped that its width w is less than the width W of the door wing 12. It is preferred that the length 1 of the slot 56 (shown in FIG. 2) minus the width w of the clamping plate 26 be less than one half the difference in the width W of the door wing 12 and the width w of the clamping plate 26 $[(1-w)<(W-w)/2]$. This limitation allows the movement of the slot without exposing the slot from behind the door wing 12. The flat plate provides maximum contact to assure gripping of the door without gouging which makes re-adjustment difficult.

Figure 3:
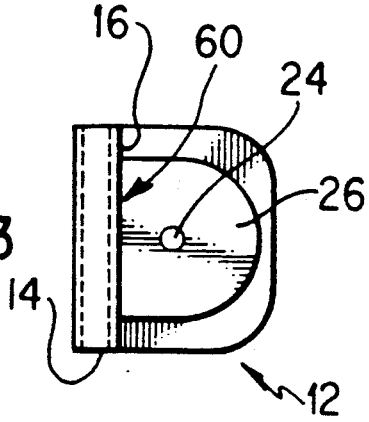
FIG. 3 is a view of a preferred clamping plate and its spacial relation to the door wing.

FIG. 3 illustrates the clamping plate 26 engages a bolt which serves as a preferred clamping means 24. The clamping plate 26 is provided with a clamping plate edge 60 which is in close proximity and substantially parallel to the second leg 16 of the door wing 12. The clamping edge 60 binds against the second leg 16 of the door wing 12 if the clamping plate 26 rotates. This assures when the bolt is employed as the clamping means 24 and the bolt will thread into and out of the clamping plate 26 as it is turned. The turning of the bolt will then provide for movement of the clamping plate 26 normal to the first leg 14 of the door wing 12. The normal movement of the clamping plate 26 allows the door (now shown) to be adjusted.

Figure 4:
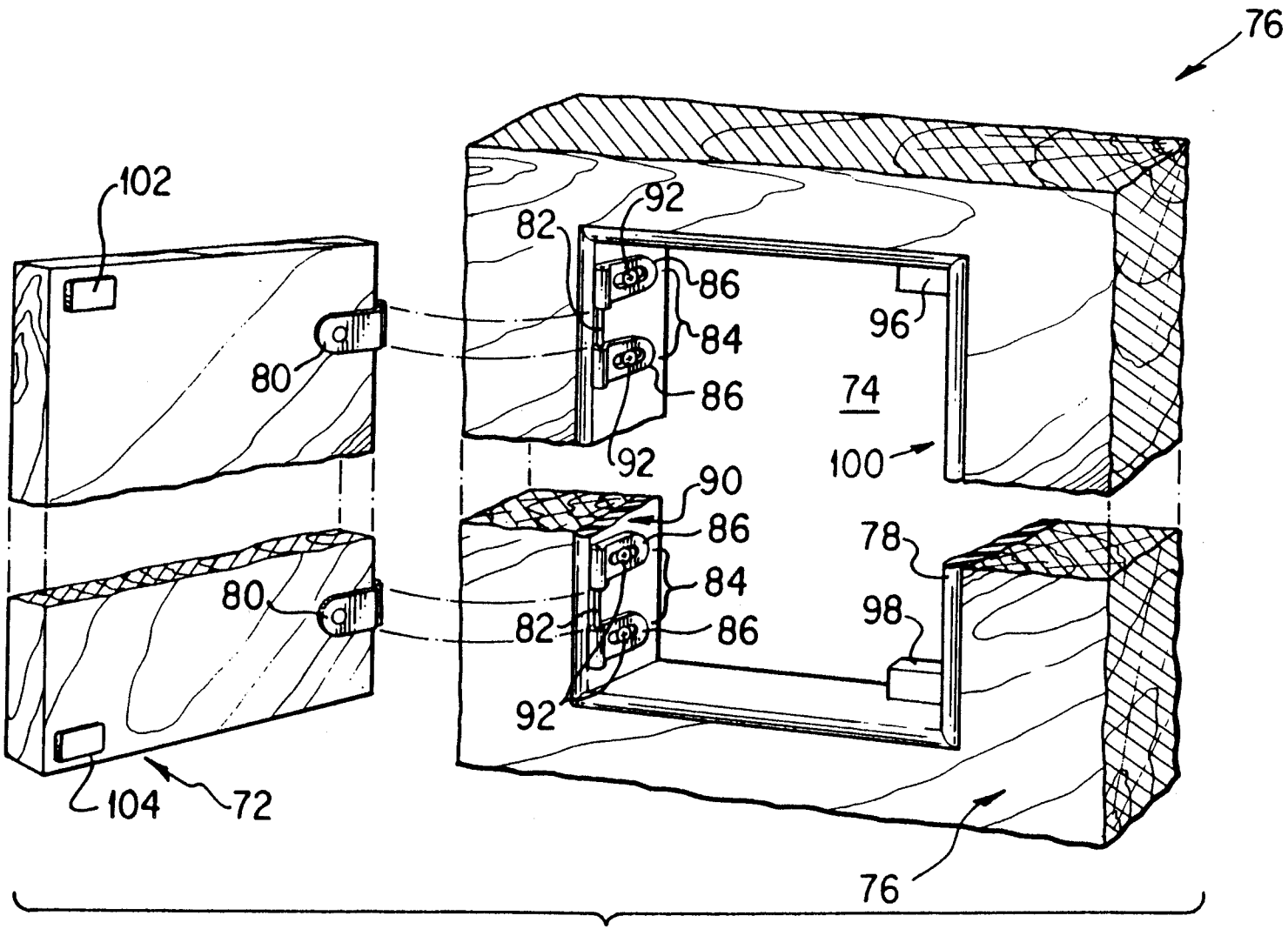
FIG. 4 illustrates details of a cabinet closure system of the present invention which includes dual closure elements.

FIG. 4 illustrates a cabinet closure system 70 for an inset door 72 which employs the hinge of the present invention illustrated in FIG. 1 as an element of the cabinet closure system 70. The inset door 72 closes an opening 74 of a door frame 76. A decorative facing 78 boarders the door opening 74 and is attached thereto. The door 72 has attached thereto door wings 80. The door wings engage the hinge pins 82 which are supported by the cabinet split wings 84. The split wing tabs 86 are spaced apart with a separation sufficient to accommodate the second leg 88 of the door wing 80 (shown in FIG. 5). Having the tabs 86 so spaced minimizes the separation between the door 72 and the mounting sidewall 90 when the door 72 is in the closed position. The tabs 86 are screwed into the mounting sidewall 90 of the door opening 74 with screws 92 which are illustrated best in FIG. 5.

Figure 5:
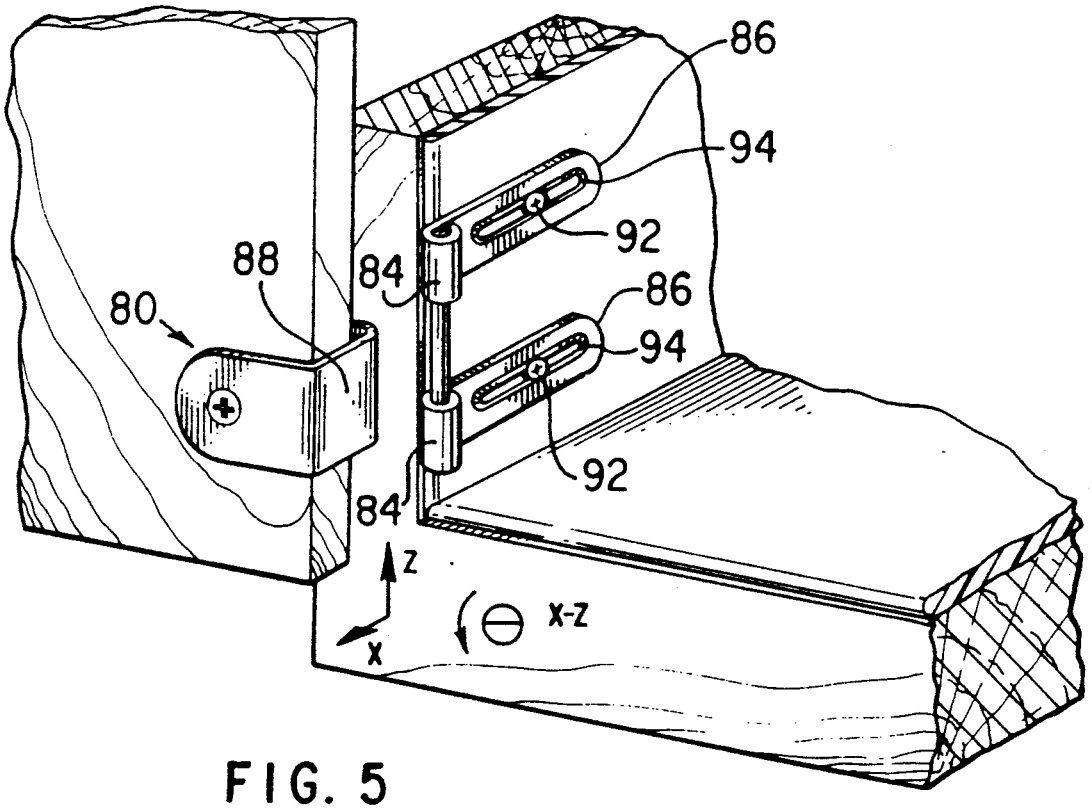
FIG. 5 is an enlarged view of the split hinge wing illustrated in FIG. 4 illustrating details of how it attaches to the frame for the door.

As illustrated in FIG. 5 slots 94 in the wing tabs 86 through which screws 92 pass allow adjustment in the x-z plane for both translation and rotation as is illustrated in FIG. 4. A combination of the x-z translation and rotation in combination with the y-z translation and rotations for the door allow five degrees of freedom and thus maximizes the ability to adjust the door with respect to the hinge mounting sidewall 88.

Figure 6:
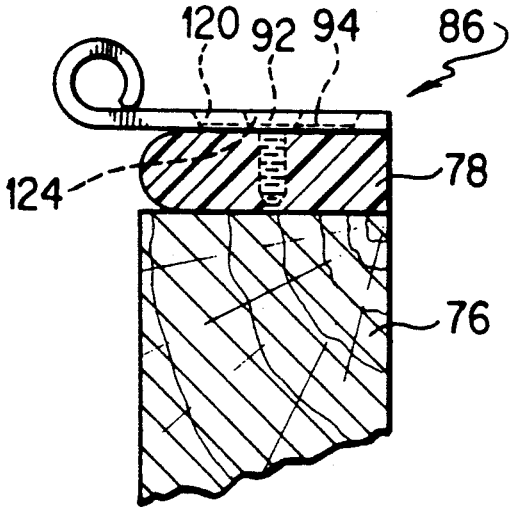
FIG. 6 is a detailed section of the slot configuration in the split wing tab of one preferred embodiment of the present invention.

FIG. 6 illustrates in greater detail the slot configuration for the split wing tab 86. The slot 94 has a counter sunk region 120 that mates with the underside 124 of the head of the screw 92. The screws pass through the decorative facing 78 and are affixed in the door frame 76 assuring that the door is secured. This design provides a secure attachment of the cabinet wings 84 (shown in FIGS. 4 and 5) to the sidewall 88 which would not be readily obtained with the slotted cabinet wing of the '419 patent. If the clamping plate of the '419 patent were employed and a decorative facing 78 attached to the door opening 74 (shown in FIG. 4) the clamping plate would maintain its support principally from the decorative facing 78 which is not structural. Thus even without consideration of the problem of concealing the cabinet wing the fully adjustable hinge of the '419 patent would not be suitable for inset doors with decorative facings around the door opening 74.

Preferably the counter sunk region 120 of the slot 94 is about ⅛ in. greater in length than the diameter of the head of the screw 92. Likewise the diameter of the screw should be about 1/16 in. less than the slot width to provide for rotational freedom of the hinge. This coupled with the tolerances between the door knuckle passage and the pin assure adequate rotational freedom to allow alignment of the corners bound by the hinges Preferably the passage in the door wing knuckle is provided with a clearance of between about 0.001 and 0.0025 per inch of passage length. These clearances provide flexibility in the hinge elements and provide for slight rotation between the two hinge wings.

Referring again to FIG. 4, it is preferred that the closure system 70 be fitted with a pair of catch mechanisms with the first receptor 96 and the second receptor 98 being positioned in close proximity to the sidewall 100 opposite the hinge mounting sidewall 90. Furthermore the receptors 96 and 98 are spaced apart such that they lie in close proximity to the corners of the door opening 74. The door 72 has a first catch 102 which engages the first receptor 96 while the second catch 104 engages the second receptor 98.

Having a pair of catch mechanisms so located assures that the associated corners of the door 72 will align with the corners of the door opening 72. It is further preferred that the receptors 96 and 98 be magnets and that the catches 104 and 106 be ferromagnetic materials. Having magnetic activated catch mechanisms provides a continuous force to be applied to the corners of the door 72 to draw then into registry with the corners of the door opening 72.

While the present invention has been described in terms of preferred embodiments and particular applications, substitution in detail and design by one skilled in art can be made without departing from the spirit of the invention.

What we claim is:

1. A hinge assembly for an inset door which mounts to a sidewall of a door frame and swingably engages the door frame, the inset door having a slot substantially normal to an edge of the door forming a slotted edge and an opening in the back surface of the door communicating with the slot, the hinge assembly comprising;

a door wing having a first leg and a second leg which meet at an intersection forming about a 90° angle, said first leg overlying the back surface of the door and said second leg overlying the edge of the door and extending there beyond;

a second leg knuckle defining an end of said second leg, said second leg knuckle having a second leg passage therethrough, said second leg passage being substantially parallel to said intersection of said first leg and said second leg;

a first leg passage through said first leg;

a fastening means passing through said first leg passage and through the opening in the back surface of the door;

a clamping plate substantially parallel to said first leg engaging said fastening means, said clamping plate being engageable in the slot in the slotted edge of the door;

a split cabinet wing having a first wing tab spaced apart from a second wing tab with said second leg of said door wing fitting therebetween when the door is in a closed position, said first wing tab having a first wing tab knuckle with a first wing tab knuckle passage therethrough and a first elongated wing tab slot substantially normal to said first wing tab knuckle, and said second wing tab having a second wing tab knuckle with a second wing knuckle passage therethrough and a second elongated wing tab slot substantially normal to said second wing tab knuckle; and a pin passing through said second leg passage in said second leg knuckle and said first wing tab passage and said second wing tab passage, said first wing tab knuckle passage and said second wing tab knuckle passage being located adjacent to the opposite ends of said second leg passage in said second leg knuckle.

2. The hinge assembly of claim 1 wherein said first wing tab and said second wing tab are fixably attached to said pin.

3. The hinge of claim 2 wherein said fastening means is a bolt.

4. The hinge assembly of claim 3 wherein said clamping plate is provided with a clamping plate edge in close proximity and substantially parallel to said second leg of said door wing.

5. The hinge assembly of claim 1 wherein said slots have counter sunk regions and further comprising:

screws having heads, said screws passing through said first wing tab slot and said second wing tab slot with said heads mating with said counter sunk regions of said slots.

6. The hinge assembly of claim 5 wherein each of said slots has a width and each of said screws has a diameter which is about 1/16 in. less than said slot width.

7. A cabinet closure system for an inset door which mounts in an opening bounded by four corners having a first sidewall to which hinges are mounted and a second opposite sidewall comprising:

a door wing having a first leg and a second leg which meet at an intersection forming about a 90° angle, said first leg overlying the back surface of the door and said second leg overlying the edge of the door and extending there beyond;

a second leg knuckle defining an end of said second leg, said second leg knuckle having a second leg passage therethrough, said second leg passage being substantially parallel to said intersection of said first leg and said second leg;

a first leg passage through said first leg;

a fastening means passing through said first leg passage and through the opening in the back surface of the door;

a clamping plate substantially parallel to said first leg engaging said fastening means, said clamping plate being engageable in the slot in the slotted edge of the door;

a split cabinet wing having a first wing tab spaced apart from a second wing tab with said second leg of said door wing fitting therebetween when said inset door is in a closed position, said first wing tab having a first wing tab knuckle with said first wing tab knuckle passage therethrough and a first elongated wing tab slot substantially normal to said first wing tab knuckle, and said second wing tab having a second wing tab knuckle with a second wing tag knuckle passage therethrough and a second elongated wing tab slot substantially normal to said second wing tab knuckle;

a pin passing through said second leg passage in said second leg knuckle and said first wing tab passage and said second wing tab passage, and said first wing tab knuckle passage said second wing tab passage being located adjacent to the opposite ends of said second leg passage in said second leg knuckle;

a first catch mechanism; and a second catch mechanism, said catch mechanisms being spaced apart and in close proximity to the corners bounding the second sidewall.

8. The cabinet closure system of claim 7 wherein said catch mechanisms are magnetic.

* * * * *

UNITED STATES PATENT AND TRADEMARK OFFICE

CERTIFICATE OF CORRECTION

PATENT NO. : 5,067,200

DATED : November 26, 1991

INVENTOR(S) : Norman Stowell, Brian D. Stowell, Gregory T. Stowell

It is certified that error appears in the above—identified patent and that said Letters Patent is hereby corrected as shown below:

Column 6, line 45, after "with" delete "said" and substitute therefore --a--.

Column 6, line 49, after "second wing" delete "tag" and substitute therefore --tab--.

Signed and Sealed this

Thirtieth Day of March, 1993

*Attest:*

STEPHEN G. KUNIN

*Attesting Officer*

*Acting Commissioner of Patents and Trademarks*